US007362344B2

(12) United States Patent
Kama

(10) Patent No.: US 7,362,344 B2
(45) Date of Patent: Apr. 22, 2008

(54) THERMAL DEVELOPING APPARATUS

(75) Inventor: Takeshi Kama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 204 days.

(21) Appl. No.: 11/294,529

(22) Filed: Dec. 6, 2005

(65) Prior Publication Data

US 2006/0119697 A1 Jun. 8, 2006

(30) Foreign Application Priority Data

Dec. 7, 2004 (JP) ..... P.2004-354332

(51) Int. Cl.
*G03D 13/00* (2006.01)

(52) U.S. Cl. ..... 347/140; 355/27; 430/353

(58) Field of Classification Search ..... 219/216; 430/350, 353; 355/27; 347/140, 156
See application file for complete search history.

(56) References Cited

U.S. PATENT DOCUMENTS 6,288,370 B1 * 9/2001 Ogawa et al. ..... 219/469
6,297,476 B1 * 10/2001 Kashino et al. ..... 219/216

FOREIGN PATENT DOCUMENTS

JP 2004-101679 A 4/2004

* cited by examiner

*Primary Examiner*—Huan Tran
(74) *Attorney, Agent, or Firm*—Sughrue Mion, PLLC

(57) ABSTRACT

A thermal developing apparatus for thermally developing a latent image formed on a thermal developing recording material by a thermal developing portion, the apparatus comprising: a heating unit that heats the thermal developing recording material carried to the thermal developing portion, the heating unit comprising a plurality of heating portions that are aligned in a direction that intersects orthogonally with a carrying direction of the thermal developing recording material; and a plurality of temperature measuring portions that measure temperatures of the plurality of heating portions respectively, each of said plurality of temperature measuring portions being arranged to measure a center portion of a temperature distribution in each of said plurality of heating portions.

4 Claims, 4 Drawing Sheets

THERMAL DEVELOPING APPARATUS

BACKGROUND OF THE INVENTION

1. Field of the Invention

The present invention relates to a thermal developing apparatus for thermally developing a latent image, which is formed on an image forming layer of a thermally developing recording material, by heating the thermally developing recording material.

2. Description of the Related Art

In recent years, the thermal developing apparatus and the thermal developing/recording apparatus that never applies the wet process and uses the dry system have been proposed. In such thermal developing apparatus and such thermal developing/recording apparatus, the photosensitive and/or thermal recording material (photosensitive/thermal recording material) or the film-like recording material containing the thermally developing photosensitive material (referred to as a "thermally developing recording material" hereinafter) is used as the recording medium. Also, in the thermal developing apparatus and the thermal developing/recording apparatus using the dry system, the latent image is formed by radiating (scanning) the laser beam onto the thermally developing recording material in the exposing portion, then the thermal development is carried out by bringing the thermally developing recording material into contact with the heating means in the thermal developing portion, and then the thermally developing recording material on which the image is formed is discharged to the outside of the apparatus.

There is the thermal developing apparatus having the heat plate, which is arranged to come into surface-contact with the thermally developing recording material to be carried, as the heating means provided to the thermal developing portion. In case the thermally developing recording material is heated by using the heat plate, a temperature difference is generated in respective regions where the thermally developing recording material comes into contact with the heat plate, and then unevenness of a density is sometimes generated in the thermal developing/recording apparatus after the development. For this reason, a plurality of heating portions each having a heating surface of the heat plate, which is obtained by dividing the contact surface of the thermally developing recording material into plural regions, are provided and then these plural heating portions are controlled by controlling devices at the time of thermal development respectively, so that it is prevented that such unevenness of the density is generated in the thermally developing recording material after the development (see JP-A-2004-101679, for example).

FIG. 5A is a view explaining a configuration of the thermal developing portion of the thermal developing apparatus in the related art, and FIG. 5B is a graph showing a heating temperature at respective positions of the heat plate of the thermal developing portion in FIG. 5A.

As shown in FIG. 5A, in the thermal developing apparatus to which a heat plate 1 consisting of a plurality of heating portions 2, 3, 4 was provided, a plurality of temperature measuring portions 5*a*, 5*b*, 5*c* such as a thermistor, or the like were provided to the thermal developing apparatus to control appropriately a temperature of heating surfaces of respective heating portions 2, 3, 4. Then, the temperature was measured at center positions of the heating surfaces of the heating portions 2, 3, 4 respectively in the direction that is perpendicular to the carrying direction of the thermally developing recording material F (the lateral direction in FIGS. 5A and 5B).

Meanwhile, the temperature was low at the end portion of the heat plate 1 in the direction that is perpendicular to the carrying direction of the thermally developing recording material F, and the temperature was high near the center region. Thus, as shown in FIG. 5B, the temperature was changed in the direction that is perpendicular to the carrying direction of the thermally developing recording material F. Therefore, a difference was caused between the temperature measured by the temperature measuring portions 5*a*, 5*b*, 5*c* and the ambient temperature of measuring portions of the heat plate 1. Thus, it was extremely difficult to control the heating portions 2, 3, 4 respectively such that the heat plate 1 should be kept at a substantially constant temperature as a whole at the time of thermal development.

Also, as shown in FIG. 5A, in the case where the temperature was measured at the center positions of the heating portions 2, 3, 4 by the temperature measuring portions 5*a*, 5*b*, 5*c* respectively, when the temperature at the regions near the end portions of the heat plate 1 (portions indicated by P1 and P4 in FIG. 5B) is kept at a predetermined temperature T (about 120° C.), the so-called overheating was generated in the center portions the temperature of which was higher than the regions near the end portions (portions indicated by P2 and P3). As a result, in some cases the unevenness of the heating temperature was generated in the heat plate 1.

SUMMARY OF THE INVENTION

The present invention has been made in view of the above circumstances, and it is an object of the present invention to provide a thermal developing apparatus capable of preventing control of a heating temperature during thermal development from becoming difficult, by eliminating unevenness in a temperature distribution of a heating unit.

The above object of the present invention can be attained by providing a thermal developing apparatus for thermally developing a latent image formed on a thermal developing recording material by a thermal developing portion, which includes a heating unit having a plurality of heating portions that are aligned in a direction that intersects orthogonally with a carrying direction of the thermal developing recording material, for heating the thermal developing recording material carried to the thermal developing portion; and a plurality of temperature measuring portions for measuring temperatures of the plurality of heating portions respectively; wherein each of the plurality of temperature measuring portions are arranged to measure a center portion of a temperature distribution in each of the heating portions.

The thermal developing apparatus according to the present invention is constructed to have the temperature measuring portions and to measure the center portion of the temperature distribution in each of a plurality of heating portions by the temperature measuring portions respectively. Thus, in contrast to the case where the center position in the heating portions, which are aligned as the heating unit in the direction that intersects orthogonally with the carrying direction of the thermally developing recording material, in the orthogonal direction is measured, the temperature difference between the measuring position and surrounding positions can be reduced by measuring the center portion of the temperature distribution in respective heating portions, as set forth in this application. Therefore, it can be prevented that control of adjusting the temperature of the heating portions in response to the temperature measured by the temperature measuring portions becomes complicated at the time of thermal development. Also, the heating portions in the heating unit can be controlled more precisely. In this manner, it can be prevented that unevenness of the density of the recording material F that was subjected to the thermal development is generated due to generation of unevenness of the heating temperature of the heat plate 51.

The thermal developing apparatus is constructed such that the said plurality of heating portions comprise a plurality of heat plates aligned in the direction that intersects orthogonally with the carrying direction of the thermal developing recording material.

Also, it is preferable that, in the thermal developing apparatus, a temperature difference between the highest temperature portion and the lowest temperature portion in the heating unit lies in a range from 0.1° C. to 5° C.

Also, it is preferable that, in the thermal developing apparatus, said plurality of heating portions comprise: a first outer heating portion provided at a first end of the heating unit; and a second outer heating portion provided at a second end of the heating unit, the first and second ends being provided at outer positions of the heating unit in the direction that intersects orthogonally with the carrying direction of the thermal developing recording material, wherein said plurality of temperature measuring portions comprises a first outer temperature measuring portion and a second outer temperature measuring portion, and wherein the first and second outer temperature measuring portions measure temperatures at outer positions, of the first and second outer heating portions, with respect to center positions of the first and second outer heating portions, respectively.

DETAILED DESCRIPTION OF THE INVENTION

An embodiment of the present invention will be explained in detail with reference to the drawings hereinafter.

Figure 1:
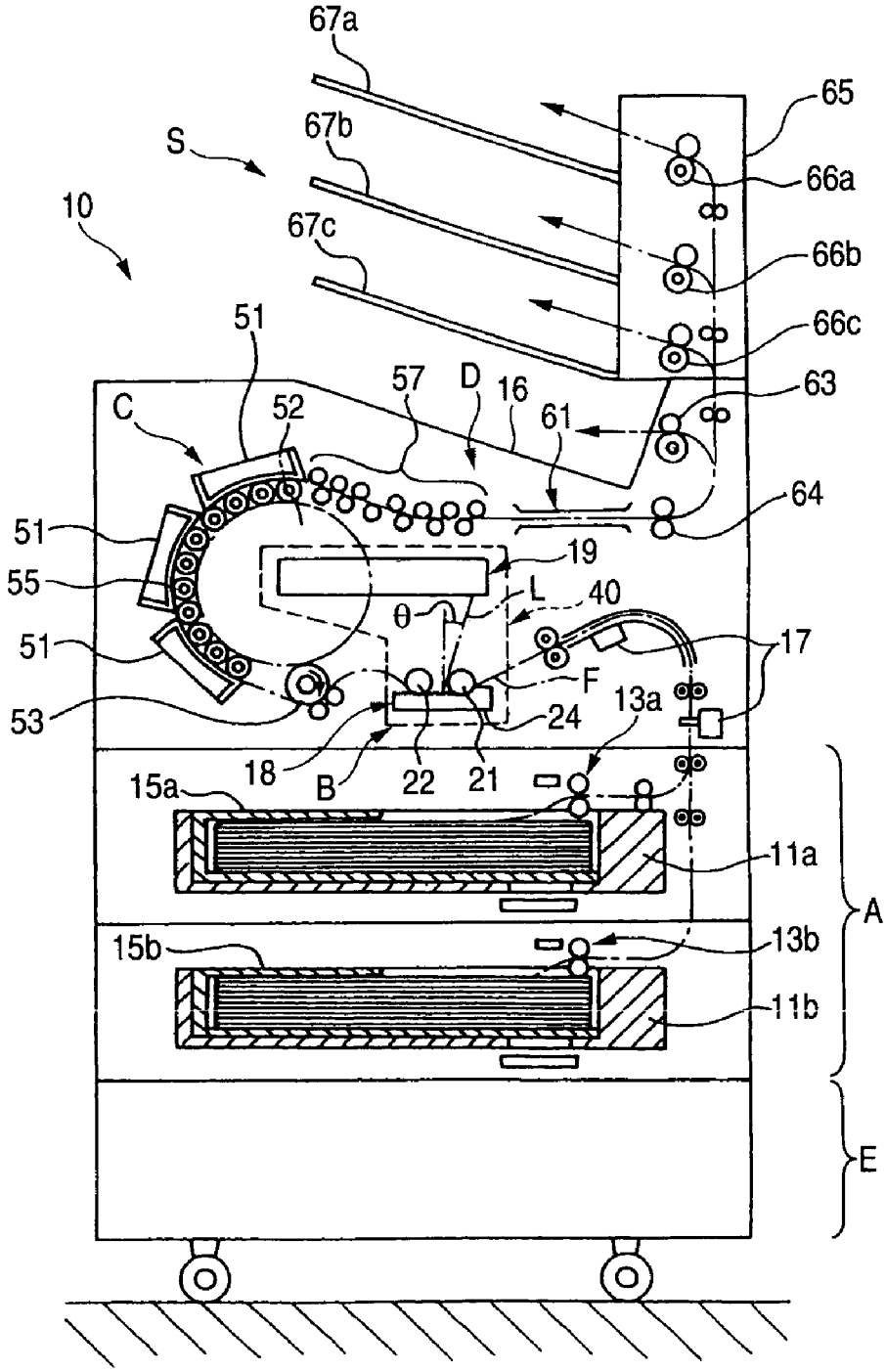
FIG. 1 is a view showing an embodiment of a thermal developing apparatus according to the present invention.

FIG. 1 is a view showing an embodiment of a thermal developing apparatus according to the present invention.

As shown in FIG. 1, a thermal developing apparatus 10 of the present embodiment has such a configuration that a sheet-like thermally developing recording material (referred to as a "recording material" hereinafter) F that does not need the wet developing process is employed as the image recording material, then a latent image is formed by irradiating a laser light L that is modulated based on an image signal input into the recording material F, and then a visible image is obtained on a surface of the recording material by thermally developing the recording material F. In this case, the present invention is not limited to such configuration. The present invention can be applied to such a configuration that the image is formed by exposing previously the sheet-like recording material by the laser light L and thus the thermal development is applied to the recording material.

The thermal developing apparatus 10 is constructed schematically by a thermally developing recording material supplying portion A, an image exposing portion B, a thermal developing portion C, and a cooling portion D in sequence in the carrying direction of the recording material F. Also, the thermal developing apparatus 10 includes a carrying unit provided to main points between respective portions to carry the recording material F, and a power supply/controlling portion E for controlling respective portions.

In the configuration of the thermal developing apparatus 10, the power supply/controlling portion E is arranged at the lowest stage, the thermally developing recording material supplying portion A is arranged at the upper stage, and the image exposing portion B, the thermal developing portion C, and the cooling portion Dare arranged at the further upper stage. Also, the image exposing portion B and the thermal developing portion C are arranged adjacently.

According to this configuration, both steps of the exposing step and the thermally developing step can be applied to a sheet of recording material F in the same carrying path. Also, a carrying path length of the recording material F can be reduced shortest by executing the exposing step and the thermally developing step within the short carrying distance, and thus an output time necessary for a sheet of recording material can be reduced.

As the recording material F, the thermally developing photosensitive material or the photosensitive/thermal recording material a thickness of which is about 0.2 mm (0.1 mm to 0.3 mm) can be used. In the thermally developing photosensitive material, the image is recorded (exposed) by the laser light L and then the color development is executed by the thermal development. Also, in the photosensitive/thermal recording material, either the image is recorded by the laser light L and then the color development is executed by the thermal development or the image is recorded by a heat mode (heat) of the laser light L and simultaneously the color is developed and then the image is fixed by irradiating the light.

The thermally developing recording material supplying portion A takes out the recording material F one sheet by one sheet, and supplies the recording material F to the image exposing portion B positioned at the downstream in the carrying direction of the recording material F. This material supplying portion A is constructed to include a plurality (two, in the present embodiment) of loading portions 11*a*, 11*b*, feeding roller pair 13*a*, 13*b* arranged to the loading portions 11*a*, 11*b* respectively, and carrying rollers and carrying guides (not shown). Magazines 15*a*, 15*b* into which the recording material F having a different size are incorporated are inserted into the inner portions of the loading portions 11*a*, 11*b* that are provided as a two-stage configuration. The magazines 15*a*, 15*b* loaded into respective stages are used selectively in response to a size and an orientation of the recording material F. In this case, the arrangement of the loading portions is not limited to the two-stage configuration. A single stage configuration may be employed, or a three-stage configuration or more may be employed.

The image exposing portion B exposes the image by scanning the laser light L on the recording material F fed from the thermally developing recording material supplying portion A in the main scanning direction while carrying the recording material F in the vertical scanning direction (i.e., the carrying direction) that is substantially perpendicular to the main scanning direction. Thus, the image exposing portion B forms a latent image in response to a desired image on an image forming layer provided on a surface of the recording material F.

The thermal developing portion C executes the thermal development by executing the temperature-rising process while carrying the recording material F after the scanning exposure. Then, the recording material F is cooled in the cooling portion D after the developing process, and carried out to a discharge tray 16.

As shown in FIG. 1, a sorter S for holding the carried recording material F is provided to the discharge tray 16. The sorter S has a main body 65 attached detachably to the thermal developing apparatus 10, a plurality of discharging rollers 66*a*, 66*b*, 66*c* provided to the main body 65, and a plurality of feeding portions 67*a*, 67*b*, 67*c* participated in the vertical direction of the main body 65 to hold the recording material F that is carried out from the main body 65 by a plurality of discharging rollers 66*a*, 66*b*, 66*c*. The sorter S is constructed such that, when the recording material F is carried out via any selected one of the discharging rollers 66*a*, 66*b*, 66*c*, such recording material F can be sorted appropriately in the feeding portions 67*a*, 67*b*, 67*c*, which correspond to the discharging rollers 66*a*, 66*b*, 66*c*, and be held there respectively. Here, the thermal developing apparatus 10 can be constructed in such a manner that the sorter S can be detachably attached to the upper portion of the thermal developing apparatus 10. Also, the thermal developing apparatus 10 can be constructed in such a manner that the sorter S can be omitted as the case may be, and thus the recording material F can be carried out to the discharge tray 16 only.

Pulling-over mechanisms 17 are provided along the carrying path between the thermally developing recording material supplying portion A and the image exposing portion B. Thus, the recording materials F carried from the thermally developing recording material supplying portion A are fed to the image exposing portion B in a state that their end portions are lined up in the width direction.

The image exposing portion B has a scanning exposure device 40 that exposes the recording material F by scanning the laser light. This scanning exposure device 40 consists of a vertically scanning carrying portion 18 having a fluttering preventing mechanism, which carries the recording materials F while preventing a fluttering of the recording materials F from the carrying surface, and a scanning exposing portion 19. The scanning exposing portion 19 scans (main scan) the laser light L while controlling an output of the laser in compliance with image data that are prepared separately. At this time, the recording material F is moved by the vertically scanning carrying portion 18 in the vertical scanning direction.

The vertically scanning carrying portion 18 has two driving rollers (carrying unit) 21, 22 rotating shafts of which are arranged to put the main scanning line of the scanning laser light L between them in substantially parallel with this main scanning line respectively, and a guide plate 24 arranged to oppose to these driving rollers 21, 22 and support the recording material F. This guide plate 24 supports the recording material F inserted between the driving rollers 21, 22 by bringing this recording material P into contact with respective portions in the driving rollers 21, 22 by means of an elastic repulsion force of the recording material F. This elastic repulsion force is generated by bending the recording material F along a part of peripheral surfaces of the driving rollers 21, 22 on the outer side of these driving rollers 21, 22 arranged in parallel.

In this fashion, a proper friction force is generated between the recording material F and the driving rollers 21, 22 by the elastic repulsion force of the recording material F itself. Thus, a carrying driving force is transferred from the driving rollers 21, 22 to the recording material F without fail, and then the recording material F is carried. The driving rollers 21, 22 are constructed such that, when these driving rollers are received the driving force of the driving unit such as a motor (not shown) via a transmitting unit such as a gear, a belt, or the like, these driving rollers are rotated clockwise in FIG. 1.

Also, the recording material F is pushed against an upper surface of the guide plate 24 by its elastic repulsion force. Thus, the fluttering of the recording material F on the carrying surface, i.e., the flapping in the vertical direction in FIG. 1, can be suppressed. Also, the good recording can be carried out without exposure displacement when the laser light L is irradiated onto an area of the recording material F between the driving rollers 21, 22.

As the heating member for heating the recording material F, a plurality (three, in the present embodiment) of heat plates 51 are provided to the thermal developing portion C such that they are aligned along the carrying direction of the recording material F. These heat plates 51 are arranged like a circular arc along the carrying path. The heat plate 51 functions as a heating unit that applies the thermal development when it comes into contact with the recording material F that is now carried.

Figure 2:
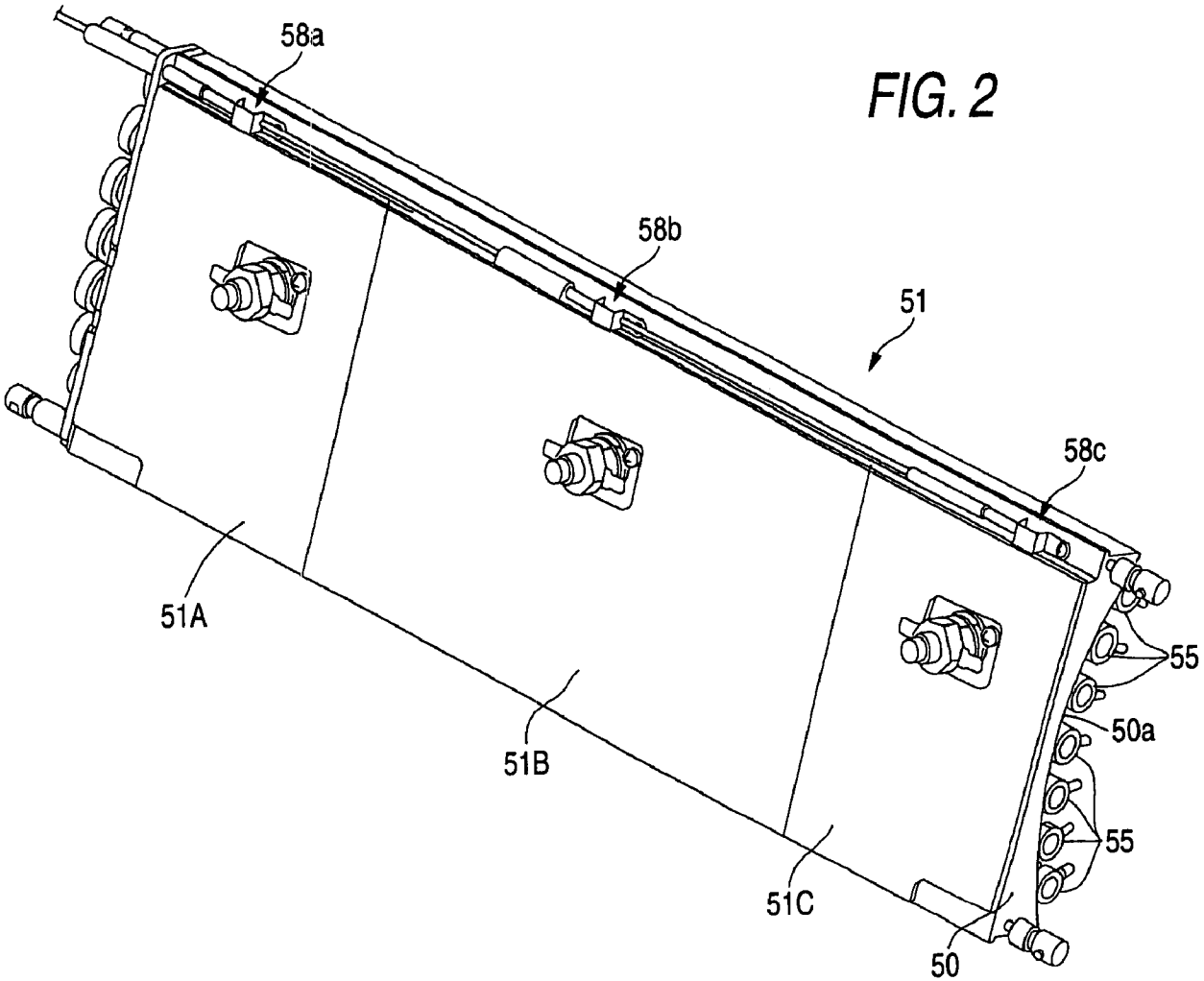
FIG. 2 is a perspective view showing a configuration of a heat plate.

FIG. 2 is a perspective view showing a configuration of a heat plate.

As shown in FIG. 2, the heat plate 51 has a plate-like guide portion 50 made of aluminum. A heating surface 50*a* that is curved to become hollow like a circular arc along the carrying path of the recording material F is formed on one surface of the guide portion 50. Pushing rollers 55 are arranged to come close to or come into contact with the heating surface 50*a*. The thermal development is executed by carrying the recording material F between the heating surface 50*a* and the pushing rollers 55 while bringing the recording material F into contact with the heating surface 50*a*. Also, as shown in FIG. 1, a feeding roller 53 is provided to the thermal developing portion C as a transferring unit of the recording material F. As these pushing rollers 55, a metal roller, a resin roller, a rubber roller, or the like can be utilized.

A plurality of heating portions 51A (corresponding a first outer heating portion), 51B, 51C (corresponding a second outer heating portion) formed of a silicon rubber heater are provided to the other surface of the guide portion 50 on the opposite side to the heating surface 50*a*. A plurality of heating portions 51A, 51B, 51C are aligned in the direction that is orthogonal to the carrying direction of the recording material F.

Temperature measuring portions 58*a* (corresponding to a first outer temperature measuring portion), 58*b*, 58*c* (corresponding to a second outer temperature measuring portion) such as a thermistor, or the like are provided to a plurality of heating portions 51A, 51B, 51C respectively to measure the heating temperature of the heating portions 51A, 51B, 51C.

In the present embodiment, the temperature of respective heating portions 51A, 51B, 51C of three heat plates 51 provided to the thermal developing portion C can be controlled by a controlling portion (not shown) based on measured values of the temperature measuring portions 58*a*, 58*b*, 58*c* at the time of thermal development.

Figure 3:
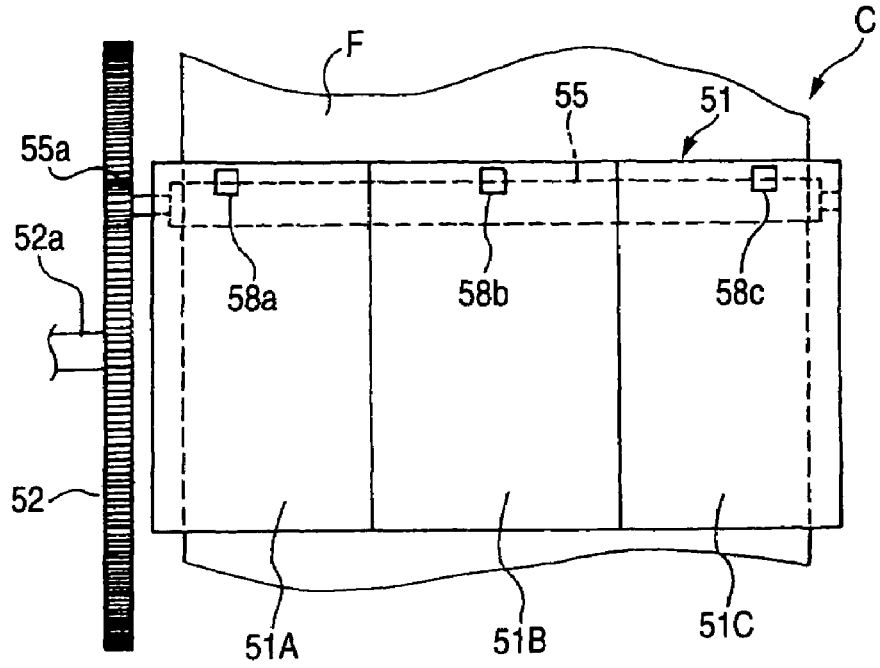
FIG. 3 is a view explaining positions of the heat plate and temperature measuring portions.

FIG. 3 is a view explaining positions of the heat plate and the temperature measuring portions.

As shown in FIG. 3, a gear portion 55*a* serving as a driven portion is provided to the end portion of each pushing roller 55 in the axial direction. The gear portion 55*a* engages with teeth on a peripheral surface of a driving gear 52 that is shaped like a hollow cylinder. The driving gear 52 is coupled to a driving source (not shown) via a drive shaft 52*a* and is rotated/driven following upon the rotation of the driving gear 52.

In the cooling portion D, a plurality of flocking rollers 57 are arranged on the downstream side of the thermal developing portion C in the carrying direction. These flocking rollers 57 transfer the recording material F, which has been subjected to the thermal development, to the further downstream in the carrying direction. A plurality of flocking rollers 57 are arranged in a zigzag along the carrying path of the recording material F. The recording material F when discharged from the thermal developing portion C is cooled gradually to the temperature below a glass transition point while being carried by the flocking rollers 57. The reason for cooling gradually the recording material F is given as follows. That is, if the recording material F is cooled quickly immediately after the thermal development, a degree of cooling becomes different at the center portion and the end portion of the recording material F in the carrying direction, and therefore the recording material F is hardened in a deformed state such as a wavy state, for example. Therefore, in order to render the progress of the cooling gentle immediately after the thermal development, a cooling efficiency must be lowered intentionally by providing a temperature holding portion, or the like.

After the recording material F is cooled gently by the flocking rollers 57, such recording material is carried to come into contact with flat planes of a pair of metal plates 61, which oppose to each other via the carrying path of the recording material F. Then, a heat of the recording material F is absorbed by the metal plates 61 and the recording material F is cooled appropriately not to generate a wrinkle and not to form a curving crease. The recording material F when discharged from the cooling portion D is carried from carrying rollers 64 to discharging rollers 63 provided on the downstream side, and then is discharged from the discharging rollers 63 (or 66*a*, 66*b*, 66*c*) onto the discharge tray 16 (or respective feeding portions 67*a*, 67*b*, 67*c* of the sorter S).

Next, a configuration of the thermal developing portion in the thermal developing apparatus of the present embodiment will be explained hereunder.

As shown in FIG. 3, the heating area of the heat plate 51 of the thermal developing portion C is partitioned into three heating portions 51A, 51B, 51C, and the temperature measuring portions 58*a*, 58*b*, 58*c* for measuring the temperature of the heating portions 51A, 51B, 51C in the thermal development are arranged in predetermined positions in the direction that intersects orthogonally with the carrying direction of the recording material F.

Figure 4:
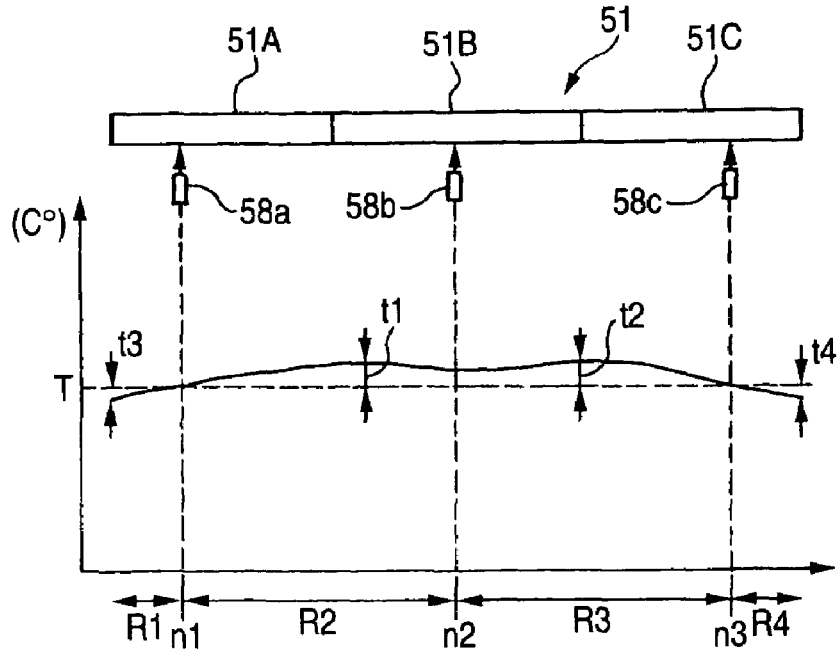
FIG. 4 is a view showing positions of the temperature measuring portions with respect to the heat plate and a heating temperature of the heat plate at the time of thermal development.
Figure 5A:
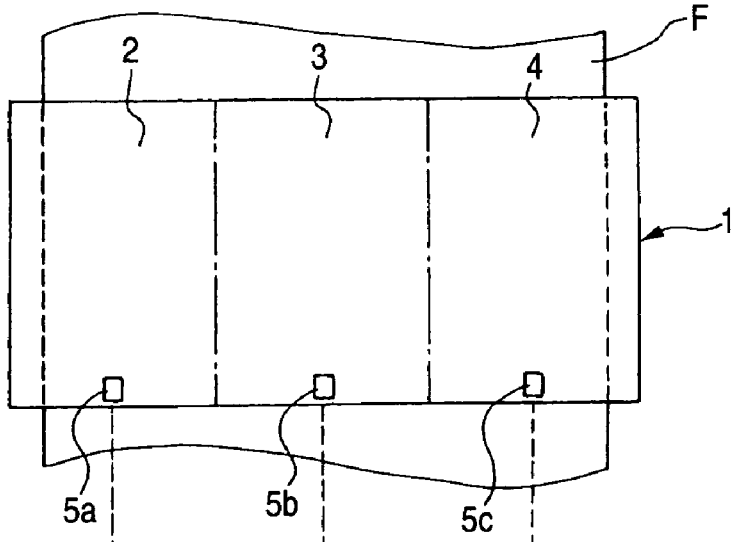
FIG. 5A is a view explaining a configuration of a thermal developing portion of a thermal developing apparatus in the related Art.
Figure 5B:
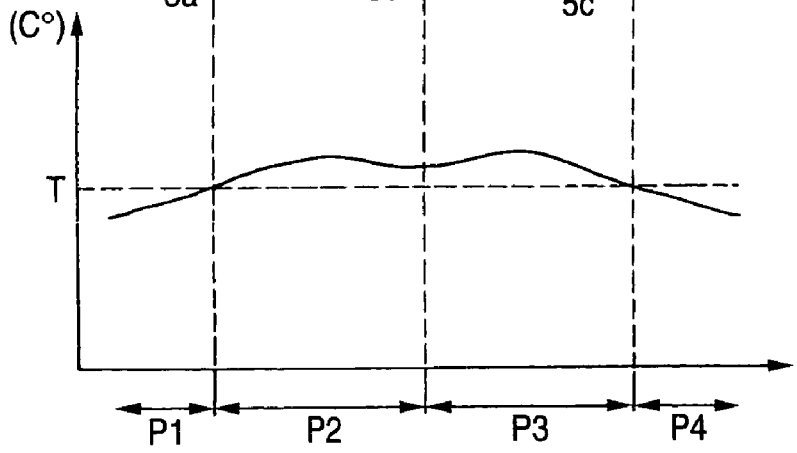
FIG. 5B is a graph showing a heating temperature at respective positions of a heat plate of the thermal developing portion in FIG. 5A.

FIG. 4 is a view showing positions of the temperature measuring portions with respect to the heat plate and a heating temperature of the heat plate at the time of thermal development.

In the thermal development, such a phenomenon on the heat plate 51 occurs that the heating temperature is hard to rise at the end portion in the direction that intersects orthogonally with the carrying direction and is ready to rise at the center position in contrast to the end portion.

In view of the above phenomenon, in the thermal developing apparatus 10 according to the present invention, a plurality of temperature measuring portions 58*a*, 58*b*, 58*c* are arranged to measure the center portion of the temperature distribution in a plurality of heating portions 51A, 51B, 51C respectively. Here, the wording "the center portion of the temperature distribution" means the position that gives an average temperature in the overall heating area of each of heating portions 51A, 51B, 51C at the time of thermal development. That is, the present embodiment is constructed such that the temperature measuring portions 58*a*, 58*b*, 58*c* are arranged to measure the center portion of the temperature distribution in the direction that intersects orthogonally with the carrying direction of the recording material F and then the temperature is controlled to a heating temperature T (about 120° C. in the present embodiment) as a target of the heat plate 51 in the thermal development based on the measured values of these temperature measuring portions 58*a*, 58*b*, 58*c*.

At that time, an efficiency to control the heating temperatures of the heating portions 51A, 51B, 51C at the target heating temperature T can be improved, and thus a temperature difference between the low temperature portion in which the temperature does not exceed the heating temperature T and the high temperature portion in which the temperature exceeds the heating temperature T can be reduced.

More concretely, like the present embodiment, if the heating portions 51A, 51B, 51C are provided in appropriate positions of the heat plate 51, the temperature at the end portion where the temperature becomes relatively low can be smoothly brought closer to the target heating temperature T. By doing this, a temperature difference t3 from the target heating temperature T in the heating portion 51A can be reduced in a heating region R1 that extends from a position n1, which is measured by the temperature measuring portion 58*a*, to the end portion (the end portion on the opposite side to the heating portion 51B). Also, a temperature difference t4 from the target heating temperature T in the heating portion 51C can also be reduced in a heating region R3 that extends from a position n3, which is measured by the temperature measuring portion 58*c*, to the end portion (the end portion on the opposite side to the heating portion 51B).

In contrast, like the present embodiment, if the heating portions 51A, 51B, 51C are provided in appropriate positions of the heat plate 51, generation of such a phenomenon that the center portion where the temperature is apt to become relatively high is heated excessively, i.e., the so-called overheating, can be suppressed. That is, temperature differences t1, t2 from the target heating temperature T can be reduced in a heating region R2 that extends from the position n1 measured by the temperature measuring portion 58*a* to a position n2 measured by the temperature measuring portion 58*b* and a heating region R3 that extends from the position n2 measured by the temperature measuring portion 58*b* to the position n3 measured by the temperature measuring portion 58*c*.

Accordingly, the thermal developing apparatus 10 is constructed in such a way that the center portion of the temperature distribution in a plurality of heating portions 51A, 51B, 51C are measured by the temperature measuring portions 58*a*, 58*b*, 58*c* respectively. Thus, unlike the conventional configuration in which the center position in the heating portions 51A, 51B, 51C in the direction that intersects orthogonally with the carrying direction of the recording material F is measured respectively, the temperature difference between the measuring position and surrounding positions can be reduced by measuring the center portion of the temperature distribution in respective heating portions 51A, 51B, 51C. Therefore, it can be prevented that the control of adjusting the heating temperature of the heating portions 51A, 51B, 51C in response to the temperature measured by the temperature measuring portions 58*a*, 58*b*, 58*c* becomes complicated at the time of thermal development. Also, the temperature of the heating area of the heat plate 51 can be controlled more precisely. In this manner, it can be prevented that unevenness of the density of the recording material F that was subjected to the thermal development is generated due to generation of unevenness of the heating temperature of the heat plate 51.

It is preferable that the temperature difference between the high temperature portion and the low temperature portion should lie in a range from 0.1° C. to 5° C. in the thermal developing apparatus 10. Also, it is preferable from a viewpoint of picture quality stability that the temperature difference should lie in a range from 0° C. to 1° C. That is, it is preferable that a sum of larger one of the temperature differences t1 and t2 and larger one of the temperature differences t3 and t4 should be suppressed within the above range. If doing this, control of the heating temperature can be executed smoothly at the time of thermal development.

The present invention is not limited to the above embodiment, and appropriate variations, improvements, and the like can be applied.

For example, the number of the heating portions that are aligned in the direction that intersects orthogonally with the carrying direction of the recording material is not limited three in the above embodiment. Two heating portions or four heating portions or more may be employed within a range in which the heating portions can be controlled appropriately in heating. At this time, if the temperature measuring portions are arranged to measure the center portion of the temperature distribution in the direction perpendicular to respective heating portions, the similar advantage to the present invention can be achieved.

According to the present invention, the thermal developing apparatus that can prevent the control of the heating temperature at the time of thermal development from becoming difficult by eliminating unevenness in the temperature distribution of the heating unit can be provided.

The entire disclosure of each and every foreign patent application from which the benefit of foreign priority has been claimed in the present application is incorporated herein by reference, as if fully set forth.

What is claimed is:

1. A thermal developing apparatus for thermally developing a latent image formed on a thermal developing recording material by a thermal developing portion, the apparatus comprising:

a heating unit that heats the thermal developing recording material carried to the thermal developing portion, the heating unit comprising a plurality of heating portions that are aligned end-to-end in an orthogonal direction that intersects orthogonally with a carrying direction of the thermal developing recording material; and a plurality of temperature measuring portions that measure temperatures of the plurality of heating portions respectively, each of said plurality of temperature measuring portions being positioned to measure a center portion of a temperature distribution, in said orthogonal direction, in a respective one of said plurality of heating portions, wherein each said center portion of said temperature distribution is at a position having a temperature which is an average temperature of an overall heating area of the respective heating portion.

2. A thermal developing apparatus according to claim 1, wherein said plurality of heating portions comprise a plurality of heat plates aligned in the direction that intersects orthogonally with the carrying direction of the thermal developing recording material.

3. A thermal developing apparatus according to claim 1, wherein a temperature difference between the highest temperature portion and the lowest temperature portion in the heating unit lies in a range from 0.1° C. to 5° C.

4. A thermal developing apparatus according to claim 1, wherein said plurality of heating portions comprise: a first outer heating portion provided at a first end of the heating unit; and a second outer heating portion provided at an opposite, second end of the heating unit in said orthogonal direction, the first and second ends being provided at respective outer positions of the heating unit in the orthogonal direction, wherein said plurality of temperature measuring portions comprises a first outer temperature measuring portion and a second outer temperature measuring portion, wherein the first and second outer temperature measuring portions measure the average temperature of said temperature distribution at outer positions of the first and second heating portions with respect to respective center positions of the first and second outer heating portions, and wherein said outer positions of said first and second heating portions coincide with respective center portions of said temperature distribution.

* * * * *